US010770821B2

(12) United States Patent
Zheng

(10) Patent No.: US 10,770,821 B2
(45) Date of Patent: Sep. 8, 2020

(54) ELECTRICAL CONNECTOR AND CONNECTOR ASSEMBLY HAVING THE SAME

(71) Applicant: Molex, LLC, Lisle, IL (US)

(72) Inventor: You-Xiang Zheng, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/412,423

(22) Filed: May 15, 2019

(65) Prior Publication Data

US 2019/0363476 A1 Nov. 28, 2019

(30) Foreign Application Priority Data

May 23, 2018 (CN) ..... 2018 1 0502737

(51) Int. Cl.

*H01R 13/436* (2006.01)
*H01R 13/46* (2006.01)
*H01R 13/627* (2006.01)
*H01R 13/428* (2006.01)

(52) U.S. Cl.

CPC ..... *H01R 13/4362* (2013.01); *H01R 13/428* (2013.01); *H01R 13/46* (2013.01); *H01R 13/6275* (2013.01)

(58) Field of Classification Search

CPC ..... H01R 13/6272; H01R 13/6271; H01R 13/6273; H01R 13/6275

See application file for complete search history.

(56) References Cited

U.S. PATENT DOCUMENTS 5,340,329 A * 8/1994 Hirai ..... H01R 13/6275 439/357
5,595,509 A 1/1997 Fry et al.
5,775,931 A * 7/1998 Jones ..... H01R 13/631 439/358
6,017,153 A * 1/2000 Carlisle ..... G02B 6/3821 385/56
6,585,536 B1 * 7/2003 Wu ..... H01R 13/6275 439/358

(Continued)

FOREIGN PATENT DOCUMENTS

CN 2513249 Y 9/2002
CN 201142451 Y 10/2008

(Continued)

*Primary Examiner* — Ross N Gushi
(74) *Attorney, Agent, or Firm* — Molex, LLC

(57) ABSTRACT

An electrical connector has an insulative housing, a plurality of conductive terminals mounted in the housing and a locking structure integrally formed on the housing. The locking structure has an elastic locking member and an elastic supporting arm. The locking member has an elastic locking arm and a locking portion provided on the locking arm, one end of the locking arm is connected to the housing, the other end of the locking arm is free and is suspended above an upper surface of the housing. The supporting arm is positioned between the locking arm and the upper surface of the housing. When the locking arm and the upper surface of the housing together apply a pressure to the supporting arm, the supporting arm is capable of providing an elastic supporting force for the locking arm in a direction away from the upper surface of the housing.

22 Claims, 5 Drawing Sheets

(56) References Cited

U.S. PATENT DOCUMENTS 6,821,024 B2 * 11/2004 Bates, III ..... G02B 6/3893 385/76
6,821,139 B1 * 11/2004 Wu ..... H01R 13/6275 439/352
7,232,329 B1 * 6/2007 Wu ..... H01R 12/62 439/358
7,686,638 B2 * 3/2010 Boyd ..... H01R 13/6272 439/344
7,785,130 B2 * 8/2010 Chen ..... H01R 13/6271 439/354
8,523,598 B2 * 9/2013 Wu ..... H01R 13/6658 439/352
8,579,646 B2 * 11/2013 Lee ..... H01R 13/6272 439/344
8,840,419 B2 * 9/2014 Huang ..... H01R 13/6272 439/352
8,979,569 B2 * 3/2015 Aekins ..... H01R 24/64 439/352
9,368,909 B2 * 6/2016 Yagi ..... H01R 13/631
9,680,255 B2 * 6/2017 Schrader ..... H01R 13/501
10,367,299 B2 * 7/2019 Yao ..... H01R 13/6272
2006/0110969 A1 * 5/2006 Wu ..... H01R 13/6273 439/352
2014/0322958 A1 * 10/2014 Wu ..... H01R 13/6275 439/372
2019/0013622 A1 * 1/2019 Miyamura ..... H01R 43/26

FOREIGN PATENT DOCUMENTS

CN 102035099 A 4/2011
CN 202601982 U 12/2012
CN 204517038 U 7/2015
DE 202005019275 U1 3/2006
JP S56-77 U 1/1981
JP H01-119180 U 8/1989
JP H02-54180 U 4/1990

* cited by examiner

ELECTRICAL CONNECTOR AND CONNECTOR ASSEMBLY HAVING THE SAME

RELATED APPLICATIONS

This application claims priority to Chinese Application No. 201810502737.1, filed on May 23, 2018, which application is incorporated herein by reference in its entirety.

TECHNICAL FIELD

The present disclosure relates to the field of electrical connector, particularly relates to an electrical connector and a connector assembly having the electrical connector.

BACKGROUND ART

U.S. Pat. No. 5,595,509 discloses an electrical connector, an insulative housing of the electrical connector is integrally formed with a locking arm thereon. When the electrical connector and a mating connector which is mated with the electrical connector are connected, the locking arm and a corresponding locking structure of the mating connector are latched with each other, so that the electrical connector and the mating connector are locked together. When the electrical connector and the mating connector needs to be separated from each other, the locking arm is pressed down, which makes the locking arm be elastically deformed and release the latching with the locking structure of the mating connector. In such an electrical connector, if an elastic coefficient of the locking arm is designed to be too large, it is difficult to press down the locking arm, both latching and separating between the locking arm and the locking structure need more effort; if the elastic coefficient of the locking arm is designed to be too small, the locking arm will be easy to plastically deform and even damage due to excessive pressure, therefore the electrical connector is needs to be further improved.

SUMMARY

The technical problem to be resolved by the present disclosure is to provide an electrical connector and a connector assembly having the electrical connector so as to overcome the deficiency existing in the above prior art, which can efficiently prevent the locking arm being damaged due to excessive pressure while ensures the sufficient locking force between the electrical connector and the mating connector.

In view of the above technical problem, the present disclosure provides an electrical connector comprising an insulative housing, a plurality of conductive terminals mounted in the insulative housing and a first locking structure integrally formed on the insulative housing. The first locking structure comprises: an elastic locking member comprising an elastic locking arm and a locking portion provided on the elastic locking arm, one end of the elastic locking arm is connected to the insulative housing, the other end of the elastic locking arm is a free end and is suspended above an upper surface of the insulative housing, the elastic locking arm has a first elasticity; an elastic supporting arm positioned between the elastic locking arm and the upper surface of the insulative housing and having a second elasticity; when the elastic locking arm and the upper surface of the insulative housing together apply a pressure to the elastic supporting arm, the elastic supporting arm is capable of providing an elastic supporting force for the elastic locking arm in a direction away from the upper surface of the insulative housing.

In view of the above technical problem, the present disclosure further provides a connector assembly comprising an electrical connector and a mating connector which are mated with each other. The mating connector is provided with a second locking structure; the electrical connector is the electrical connector as above; when the electrical connector and the mating connector is mated with each other, the locking portion of the electrical connector and the second locking structure of the mating connector are correspondingly locked with each other.

In comparison with the prior art, in the present disclosure of electrical connector, by that an elastic supporting arm is added between the elastic locking arm and the insulative housing to play the displacement stopping function for the elastic locking arm, it prevents the elastic locking arm from generating plastic deformation even being damaged due to the excessive pressure; at the same time, when the elastic locking arm is subjected to a larger pressure, the elastic supporting arm can support the elastic locking arm, which ensures a sufficient locking force between the locking portion of the elastic locking arm and the second locking structure. Moreover, the elastic supporting arm and the elastic locking member are integrally formed on the insulative housing, it is convenient for manufacturing, and the structure is reliable.

DETAILED DESCRIPTION OF THE PREFERRED EMBODIMENTS

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an embodiment of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the figures, representations of directions such as up, down, left, right, front and rear, used for explaining the structure and movement of the various parts of the present disclosure, are not absolute, but relative. These representations are appropriate when the parts are in the position shown in the figures. If the description of the position of the parts changes, however, these representations are to be changed accordingly.

Hereinafter, preferred embodiments of the present disclosure are further described in detail in combination with the figures of the present disclosure.

Referring to FIGS. 1-10, the present disclosure provides an electrical connector 1 and a connector assembly having the electrical connector 1. The connector assembly further comprises a mating connector 2 which is mated with the electrical connector 1.

In a preferred embodiment, the electrical connector 1 is a plug connector, correspondingly, the mating connector 2 which is mated with the plug connector is a receptacle connector. For sake of convenient description, herein ends of the electrical connector 1 and the mating connector 2 which are connected with each other are respectively referred to as front ends of the electrical connector 1 and the mating connector 2, ends of the electrical connector 1 and the mating connector 2 which are used to be connected with a cable or be soldered to a circuit board are respectively referred to as rear ends of the electrical connector 1 and the mating connector 2, unless otherwise specifically described, hereinafter each structure of the electrical connector 1 and the mating connector 2 related to "front" and "rear" of directional expression are all taken these as reference.

Figure 1:
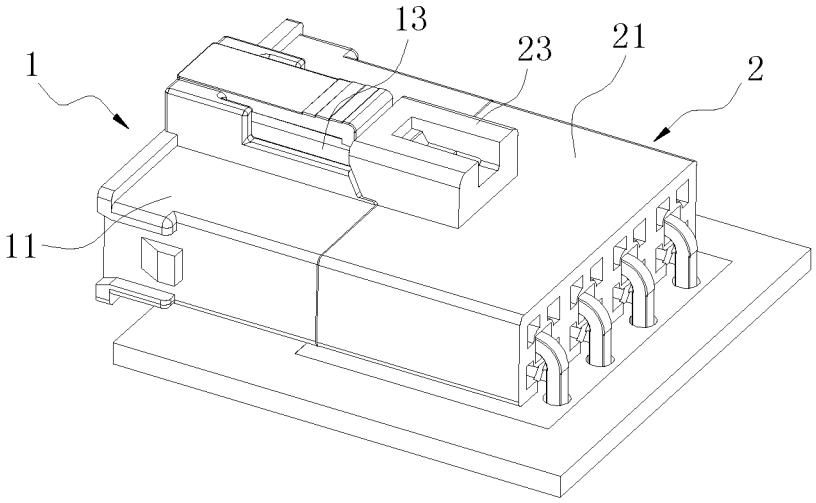
FIG. 1 is a perspective structure schematic view of a preferred embodiment of a connector assembly of the present disclosure.
Figure 2:
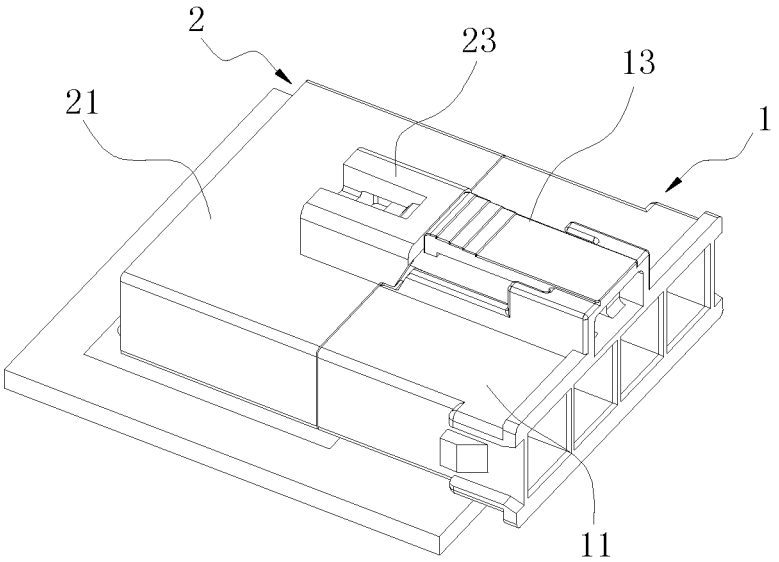
FIG. 2 is a perspective structure schematic view of FIG. 1 from another angle.
Figure 3:
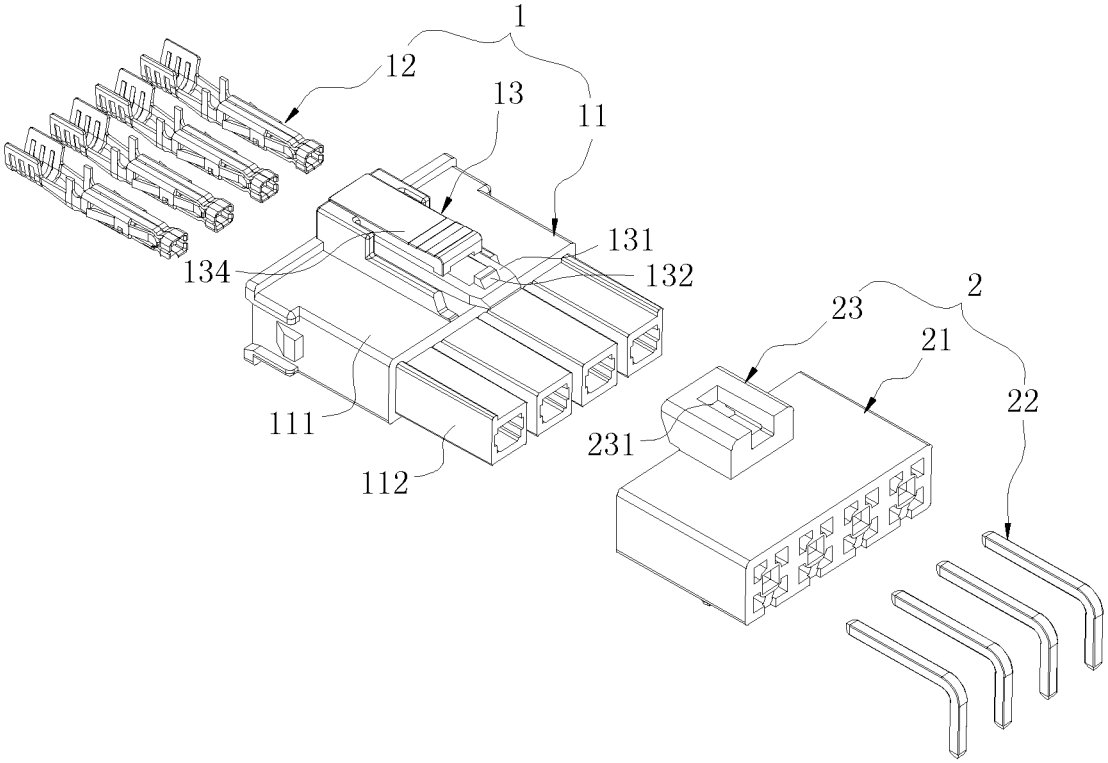
FIG. 3 is an exploded structure schematic view of the preferred embodiment of the connector assembly of the present disclosure.
Figure 4:
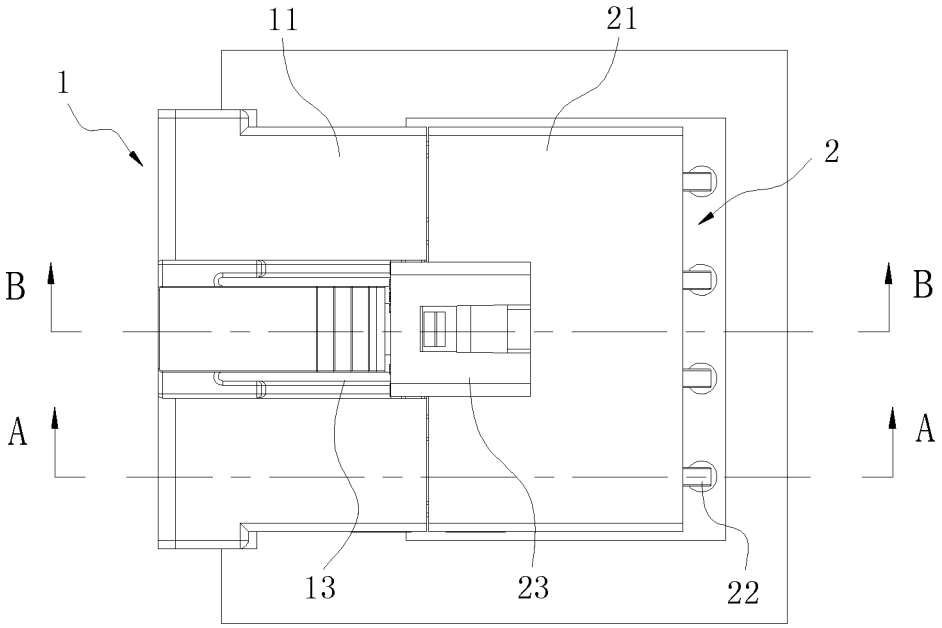
FIG. 4 is a top view of the preferred embodiment of the connector assembly of the present disclosure.
Figure 5:
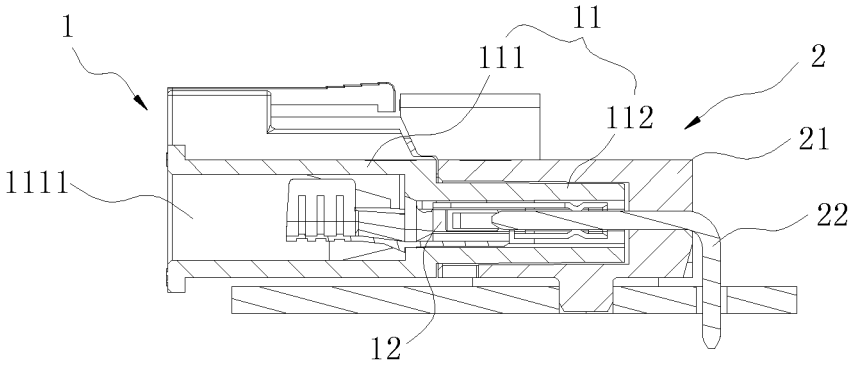
FIG. 5 is a cross sectional schematic view along a line A-A of FIG. 4.

Referring to FIG. 3, the electrical connector 1 comprises an insulative housing 11, a plurality of conductive terminals 12 inserted into the insulative housing 11 and a first locking structure 13 integrally formed on the insulative housing 11. The mating connector 2 generally comprises an outer shell 21 and a plurality of second conductive terminals 22 inserted into the outer shell 21 from a rear end of the outer shell 21, the outer shell 21 is further integrally formed provided with a second locking structure 23, the second locking structure 23 protrudes relative to a front end of the outer shell 21.

Referring to FIGS. 1, 2 and 4-6, when the electrical connector 1 and the mating connector 2 are connected, a front end of the insulative housing 11 and the front end of the outer shell 21 are mated with each other, the conductive terminal 12 and the second conductive terminal 22 are mated with each other to establish a conductive path, the first locking structure 13 and the second locking structure 23 are correspondingly locked together, so that stable and reliable connection between the electrical connector 1 and the mating connector 2 is formed.

Hereinafter a specific configuration of the electrical connector 1 is described in detail in combination with figures.

Referring to FIGS. 5-8, in the preferred embodiment, the insulative housing 11 of the electrical connector 1 is an integrally injection molding structure as whole, the insulative housing 11 comprises a base body 111 and four terminal receiving protrusions 112 protruding from a front end of the base body 111. A profile of the base body 111 generally is a rectangular structure, an interior of the base body 11 are divided into four cavities 1111 along a rectangular long side direction. The four terminal receiving protrusions 112 are arranged sided by side along the rectangular long side of the base body 111 as one row, an inner chamber of each terminal receiving protrusion 112 is communicated with the cavity 1111 in the interior of the base body 111 by one-to-one correspondence.

The number of the conductive terminals 12 corresponds to the number of the terminal receiving protrusions 112 of the insulative housing 11, a front end of each conductive terminal 12 is inserted into the terminal receiving protrusion 112 of the insulative housing 11 by one-to-one correspondence, a rear end of each conductive terminal 12 is received in the cavity 1111 of the base body 111. Corresponding to the arrangement manner of the terminal receiving protrusions 112, in the present embodiment, the conductive terminals 12 are arranged as one row. It may be understood that, the arrangement manner of the conductive terminals 12 may be adaptively adjusted as two rows according to desired electrical connection arrangement manner, correspondingly, the arrangement manner of the terminal receiving protrusions 112 of the insulative housing 11 is also adaptively adjusted.

The first locking structure 13 comprises an elastic locking member 130, an elastic supporting arm 133 provided below the elastic locking member 130 and a pressing mechanism 134 provided above the elastic locking member 130. The elastic locking member 130 is used to cooperate with the second locking structure 23 of the mating connector 2 to perform locking; the elastic supporting arm 133 is used to provide a supporting force for the elastic locking member 130 if necessary; and the pressing mechanism 134 is used to apply a pressure to the elastic locking member 130 to release the locking state of the elastic locking member 130 and the mating connector 2.

Figure 6:
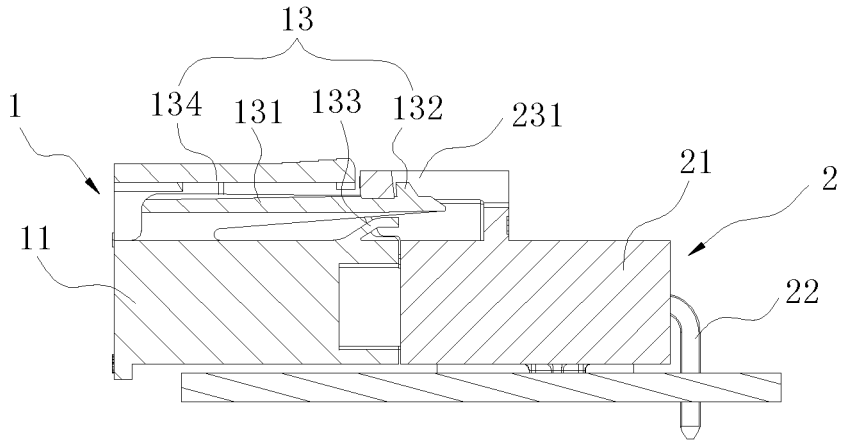
FIG. 6 is a cross sectional schematic view along a line B-B of FIG. 4.
Figure 7:
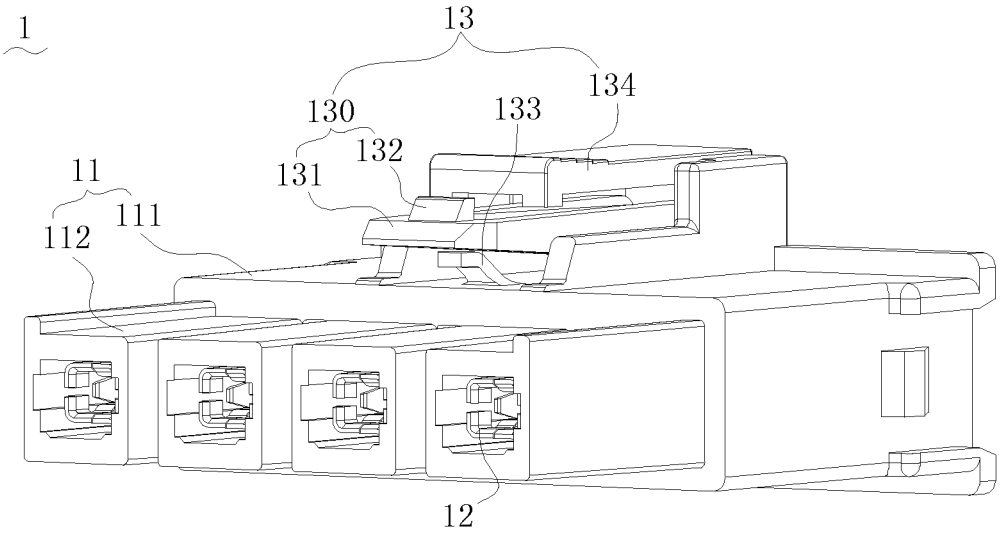
FIG. 7 is a perspective structure schematic view of an electrical connector of the connector assembly as shown in FIG. 4.
Figure 8:
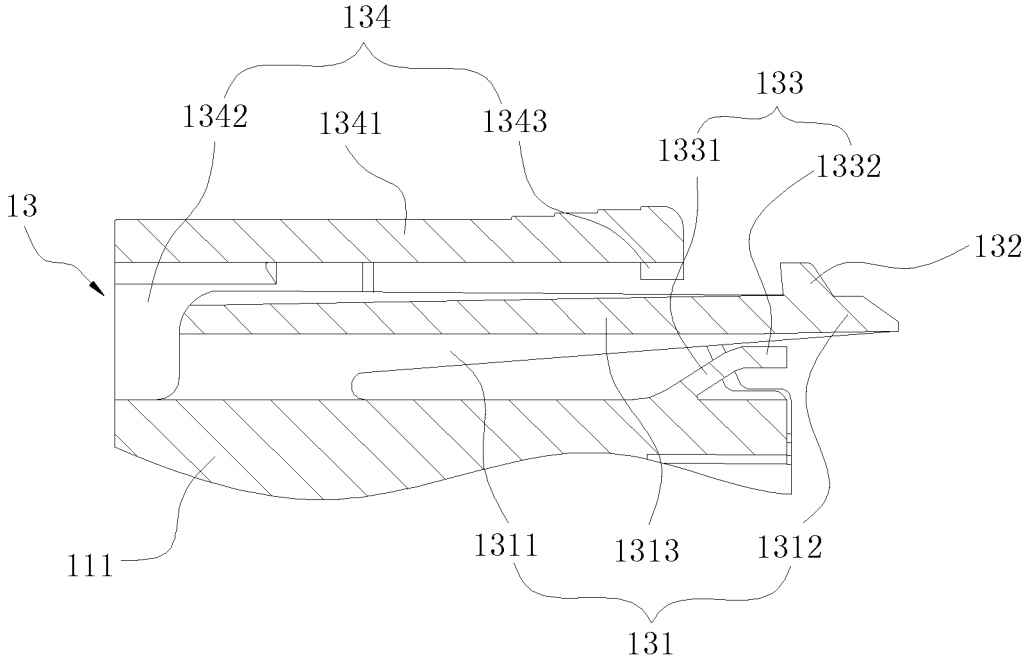
FIG. 8 is a partially enlarged schematic view at a first locking structure of the electrical connector of FIG. 4.

Taking the view angle of FIGS. 6 and 8 as reference, the elastic locking member 130 comprises an elastic locking arm 131 and a locking portion 132 formed to a front end of the elastic locking arm 131. The elastic locking arm 131 protrudes from an upper surface of the base body 111 of the insulative housing 11, a rear end of the elastic locking arm 131 is connected with an upper surface of a rear end of the base body 111, the front end of the elastic locking arm 131 is a free end, is slightly beyond a front end surface of the base body 111 and suspended above the terminal receiving protrusion 112. The elastic locking arm 131 is suspended above an upper surface of the insulative housing 11 and has a first elasticity k1 by means of an elastic cantilever structure thereof.

Referring to FIG. 8, in the present embodiment, the elastic locking arm 131 generally comprises two side support plates 1311 spaced apart from each other, a front end edge portion 1312 connecting two front ends of the two side support plates 1311 and a base plate 1313 connected between the two side support plates 1311. A rear end of the side support plate 1311 is connected to the upper surface of the base body 111, and in a direction from the rear end of the side support plate 1311 to the front end of the side support plate 1311, a cross section of the side support plate 1311 is tapered, that is, a thickness of the side support plate 1311 gradually becomes small. Such a structure of the elastic locking arm 131 makes the elastic locking arm 131 not only have better structure strength, but also have better elasticity. An end surface of a front end of the front end edge portion 1312 is designed as an oblique surface which forms a certain guiding effect and facilitates insertion of the mating connector 2.

The locking portion 132 is adaptively provided according to the second locking structure 23 of the mating connector 2, and referring to FIGS. 3, 6 and 8 together, in the present embodiment, a middle portion of the second locking structure 23 is formed with a latching hole 231 penetrating in an up-down direction, correspondingly, the locking portion 132 of the first locking structure 13 preferably is a latching hook protruding upwardly from the elastic locking arm 131, the latching hook can adaptively latch and fix with the latching hole 231 of the second locking structure 23. The locking portion 132 is positioned on the front end of the elastic locking arm 131, a width of the locking portion 132 is smaller than a width of the front end of the elastic locking arm 131, and generally is positioned in a middle portion of the elastic locking arm 131 in a width direction of the elastic locking arm 131.

Still referring to FIG. 8, in the present embodiment, the elastic supporting arm 133 comprises an oblique segment 1331 obliquely extending forwardly and upwardly from the upper surface of the base body 111 and a parallel segment 1332 bending from an upper end of the oblique segment 1331 and extending forwardly. An angle between the oblique segment 1331 and the upper surface of the base body 111 generally may be 25°~35° or so, two ends of the oblique segment 1331 are respectively smoothly transited to the upper surface of the base body 111 and the parallel segment 1332; a pressure bearing surface of the parallel segment 1332 generally is parallel to the upper surface of the base body 111, the parallel segment 1332 is a free end, preferably is suspended between the base body 111 and the elastic locking arm 131, the parallel segment 1332 and the upper surface of the base body 111 are spaced apart from each other and the parallel segment 1332 and a lower surface of the elastic locking arm 131 are spaced apart from each other, which makes the elastic supporting arm 133 also have a second elasticity k2 by means of an elastic cantilever structure of the elastic supporting arm 133. The elastic supporting arm 133 is provided close to the front end of the base body 111, the parallel segment 1332 of the elastic supporting arm 133 preferably extends to just below the locking portion 132, so that the parallel segment 1332 of the elastic supporting arm 133 may better provides a supporting force for the locking portion 132.

The pressing mechanism 134 comprises a pressing arm 1341, a supporting portion 1342 connecting a rear end of the pressing arm 1341 to the upper surface of the base body 111 and a pressing portion 1343 protruding from below a front end of the pressing arm 1341. The pressing arm 1341 is suspended above the elastic locking arm 131, may provide protection for the elastic supporting arm 133 positioned below, an upper surface of the front end of the pressing arm 1341 is step-shaped, which may increase friction and facilitate to apply a force by an operator. Preferably, the pressing portion 1343 correspondingly presses on a position in a middle portion of the side support plate 1311 of the elastic locking arm 131, which thus may provide an effort-saving lever to save the effort of the operator. When applying a force to the front end of the pressing arm 1341 to make the pressing portion 1343 press against the elastic locking arm 131, that is, the force may be applied to the elastic locking arm 131. The supporting portion 1342 is arranged to two sides of the pressing arm 1341 and is positioned at an outer side of the side support plates 1311 of the elastic locking arm 131, the supporting portion 1342 extends forwardly to the front end of the base body 111, which forms a surrounding structure positioned at an outer side of the elastic locking arm 131 and playing a certain protection effect.

Based on the above configuration, when the electrical connector 1 and the mating connector 2 are connected or connection between the electrical connector 1 and the mating connector 2 is released, by applying a pressure to the front end of the elastic locking arm 131, the elastic locking arm 131 generate elastic deformation toward the base body 111, so that the locking portion 132 can be correspondingly latched into the latching hole 231 or is removed from the latching hole 231.

At an initial stage of applying a pressure to the elastic locking arm 131, because the elastic locking arm 131 and the elastic supporting arm 133 are spaced apart from each other, the pressure only needs to overcome an elastic force $F=k1x1$ of the elastic locking arm 131 itself, where x1 is an amount of elastic deformation of the elastic locking arm 131, only applying the smaller pressure may make the elastic locking arm 131 generate elastic deformation. After the lower surface of the elastic locking arm 131 comes into contact with the elastic supporting arm 133, the elastic supporting arm 133 will play the supporting function for the elastic locking arm 131. If it is intended to further press down the elastic locking arm 131, it needs to overcome an elastic force $F=k1x1+k2x2$ of the elastic locking arm 131 and the elastic supporting arm 133, where x2 is an amount of elastic deformation of the elastic supporting arm 133, at this time a restoring force of the elastic deformation of the elastic supporting arm 133 will provide an upward supporting force for the elastic locking arm 131, preferably, the elastic supporting arm 133 is more difficult to generate deformation than the elastic locking arm 131, that is to say, the second elastic coefficient k2 is larger than the first elastic coefficient k1, so that the elastic supporting arm 133 may efficiently prevent the elastic locking arm 131 from generating plastic deformation even being broken off due to excessive pressure, at the same time also may ensure a sufficient locking force between the locking portion 132 of the elastic locking arm 131 and the latching hole 231 of the mating connector 2 and the locking portion 132 of the elastic locking arm 131 is not easily removed from the latching hole 231 of the mating connector 2. However, in other embodiments which are not shown, the second elastic coefficient k2 may be smaller than or equal to the first elastic coefficient k1. In addition, the elastic supporting arm 133 may further generate sound when the electrical connector 1 and the mating connector 2 are mated with each other due to the elastic deformation of the elastic supporting arm 133, which facilitates identification by the operator.

After the locking portion 132 is latched into the latching hole 231 and the locking is established, the elastic locking arm 131 may be in a free state or may be in a slightly pressed state (the elastic locking arm 131 is subjected to a downward pressure from the second locking structure 23), but at this time, an amount of deformation of the elastic locking arm 131 preferably is not sufficient to make the elastic locking arm 131 come into contact with the elastic supporting arm 133, the elastic locking arm 131 and the elastic supporting arm 133 still are in a state that the elastic locking arm 131 and the elastic supporting arm 133 are spaced apart from each other, that is, the free end of the elastic supporting arm 133 preferably in a suspended state. In this way, when it needs to separate the locking portion 132 from the latching hole 231, a pressure applied at an initial stage only needs to overcome an elastic force of the elastic locking arm 131, which is beneficial to reduce an acting force required to apply for separation of the locking portion 132 from the latching hole 231.

Figure 9:
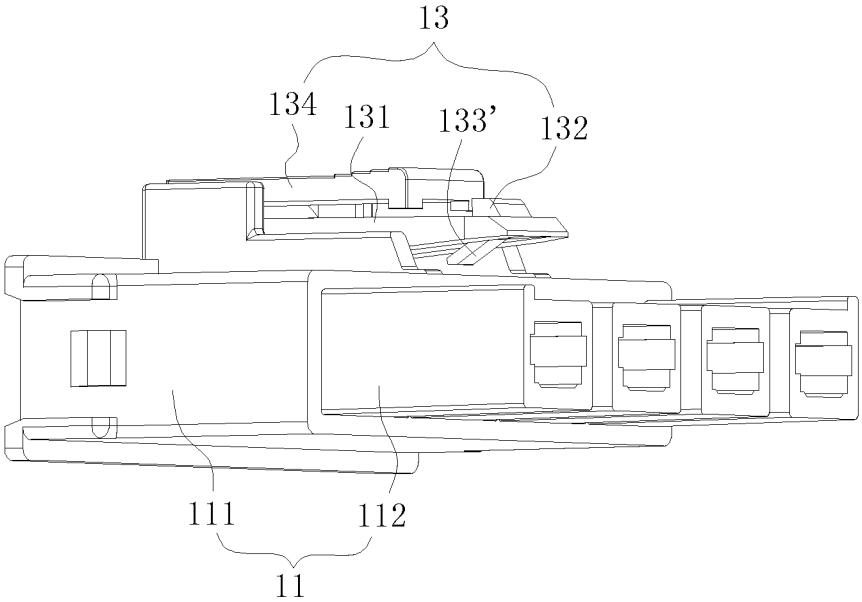
FIG. 9 is a perspective structure schematic view of another preferred embodiment of the electrical connector of the present disclosure.
Figure 10:
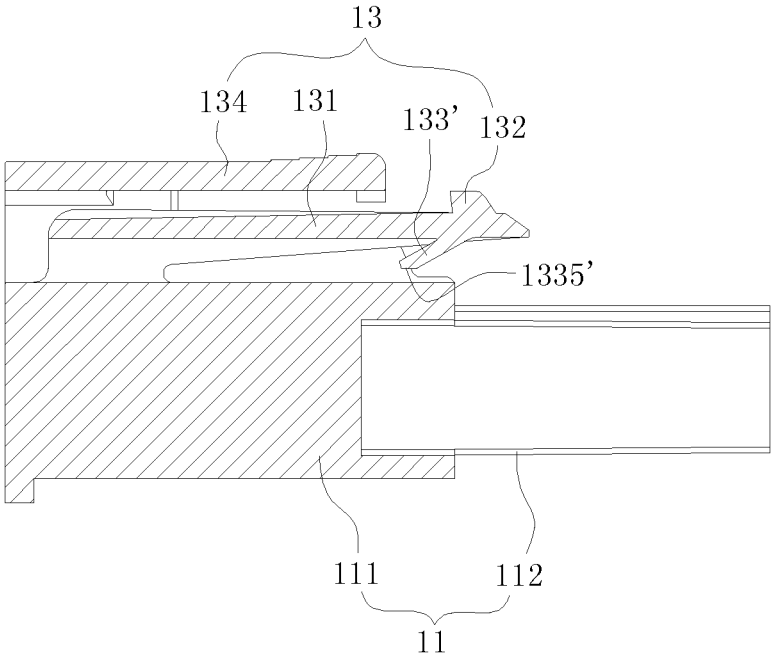
FIG. 10 is a cross sectional schematic view of the electrical connector of the present disclosure as shown in FIG. 9.

Referring to FIGS. 9 and 10, in another preferred embodiment of the electrical connector 1 of the present disclosure, an elastic supporting arm 133' of the first locking structure 13 and the elastic locking arm 131 are integrally connected together. The elastic supporting arm 133' obliquely extends backwardly and downwardly from the lower surface of the elastic locking arm 131, is in an oblique state as whole, and only comprises an oblique segment. A front end of the elastic supporting arm 133' is smoothly transited and connected to the lower surface of the elastic locking arm 131, and the front end of the elastic supporting arm 133' close to the elastic locking arm 131 is positioned just below the locking portion 132, the elastic supporting arm 133' obliquely extends in a direction from up to down toward a direction away from the front end of the elastic locking arm 131 and forms a free end, a rear end of the elastic supporting arm 133' has a chamfer, a chamfered surface 1335' formed by the chamfer is generally parallel to the upper surface of the base body 111, so the chamfered surface 1335' may better apply a pressure to the upper surface of the base body 111. And the chamfer surface 1335' and the upper surface of the base body 111 are spaced apart from each other. In the present embodiment, other configurations of the electrical connector 1 are the same as those of the previous embodiment, so description thereof is not repeated herein.

In the present embodiment, similarly, at the initial stage of applying a pressure to the elastic locking arm 131, it only needs to overcome an elastic force of the elastic locking arm 131 itself, when applying a further pressure to make the elastic supporting arm 133' abut against the base body 111 of the insulative housing 11, the elastic supporting arm 133' will play the supporting function for the elastic locking arm 131 to prevent excessive deformation of the elastic locking arm 131.

In comparison with the prior art, the present disclosure at least has the following advantages.

By that an elastic supporting arm 133, 133' is added between the elastic locking arm 131 and the base body 111 of the insulative housing 11 to play the displacement stopping function for the elastic locking arm 131, when the elastic locking arm 131 is subjected to an excessive pressure, the elastic supporting arm 133, 133' play the function thereof to generate elastic deformation, a rebound force of the elastic supporting arm 133, 133' provides a supporting force for the elastic locking arm 131, prevents the elastic locking arm 131 from generating plastic deformation even being damaged due to the excessive pressure; at the same time, when the elastic locking arm 131 is subjected to an unintentional downward (that is, toward the upper surface of the insulative housing 11) pressure, the elastic supporting arm 133, 133' can support the elastic locking arm 131, which ensures a sufficient locking force between the locking portion 132 of the elastic locking arm 131 and the second locking structure 23 of the mating connector 2, prevents the locking portion 132 of the elastic locking arm 131 from being unintentionally removed from the second locking structure 23 of the mating connector 2, so as to promote reliability of the connection. And, the elastic supporting arm 133, 133' and the elastic locking member 130 are integrally formed on the insulative housing 11, it is convenient for manufacturing, and the structure is reliable.

Further, the free end of the elastic supporting arm 133, 133' is suspended between the insulative housing 11 and the elastic locking arm 131, when the elastic locking member 130 is in a locking state (that is, the locking portion 132 and the latching hole 231 of the second locking structure 23 are latch and fixed with each other), the free end of the elastic supporting arm 133, 133' preferably is still maintained in a suspended state (that is, in the configuration as shown in FIG. 8, the parallel segment 1332 of the elastic supporting arm 133 does not come into contact with elastic locking arm 131, in the configuration as shown in FIG. 10, the lower end of the elastic supporting arm 133' does not come into contact with the upper surface of the insulative housing 11), which is beneficial to reduce the downward pressure required to apply to the elastic locking member 130 when the separation is performed.

The above described contents are only the preferred embodiments of the present disclosure, which cannot limit the implementing solutions of the present disclosure, those skilled in the art may conveniently make corresponding variation or modification based on the main concept and spirit of the present disclosure, therefore the extent of protection of the present disclosure shall be determined by terms of the Claims.

The invention claimed is:

1. An electrical connector, comprising:

an insulative housing;

a plurality of conductive terminals mounted in the insulative housing; and a first locking structure integrally formed on the insulative housing, the first locking structure comprising:

an elastic locking member comprising an elastic locking arm and a locking portion provided on the elastic locking arm; one end of the elastic locking arm being connected to the insulative housing, the other end of the elastic locking arm being a free end and being suspended above an upper surface of the insulative housing, the elastic locking arm having a first elasticity;

an elastic supporting arm positioned between the elastic locking arm and the upper surface of the insulative housing and having a second elasticity; when the elastic locking arm and the upper surface of the insulative housing together apply a pressure to the elastic supporting arm, the elastic supporting arm being, capable of providing an elastic supporting force for the elastic locking arm in a direction away from the upper surface of the insulative housing, wherein one end of the elastic supporting arm is connected to the upper surface of the insulative housing, the other end of the elastic supporting arm is a free end, wherein, in a free state, the free end of the elastic supporting arm and the upper surface of the insulative housing are spaced apart from each other, and the free end of the elastic supporting arm and a lower surface of the elastic locking arm are spaced apart from each other, and wherein the elastic supporting arm has an oblique segment, the oblique segment obliquely extends in a direction from down to up toward a direction close to the free end of the elastic locking arm, a pressure bearing surface of the free end of the elastic supporting arm are generally parallel to the upper surface of the insulative housing.

2. The electrical connector according to claim 1, wherein the elastic supporting arm is more difficult to elastically deform than the elastic locking arm.

3. The electrical connector according to claim 1, wherein the locking portion is formed to protrude upwardly from the free end of the elastic locking arm, and wherein an end of the elastic supporting arm close to the elastic locking arm is positioned just below the locking portion.

4. The electrical connector according to claim 3, wherein the elastic locking arm comprises: two side support plates spaced apart from each other and connected to the insulative housing at one end; an end edge portion connecting free ends of the two side support plates; and a base plate connected between the two side support plates;

a thickness of the side support plate gradually becomes small toward the free end of the side support plate.

5. The electrical connector according to claim 1, wherein the first locking structure further comprises a pressing mechanism, the pressing mechanism has a pressing arm suspended above the elastic locking arm and used to apply a pressure to the elastic locking arm.

6. A connector assembly, comprising:

an electrical connector and a mating connector which are mated with each other, wherein the mating connector is provided with a second locking structure;

the electrical connector is the electrical connector according to claim 1;

when the electrical connector and the mating connector is mated with each other, the locking portion of the electrical connector and the second locking structure of the mating connector are correspondingly locked with each other.

7. An electrical connector, comprising:

an insulative housing;

a plurality of conductive terminals mounted in the insulative housing; and a first locking structure integrally formed on the insulative housing, the first locking structure comprising:

an elastic locking member comprising an elastic locking arm and a locking portion provided on the elastic locking arm; one end of the elastic locking arm being connected to the insulative housing, the other end of the elastic locking arm being a free end and being suspended above an upper surface of the insulative housing, the elastic locking arm having a first elasticity;

an elastic supporting arm positioned between the elastic locking arm and the upper surface of the insulative housing and having a second elasticity; when the elastic locking arm and the upper surface of the insulative housing together apply a pressure to the elastic supporting arm, the elastic supporting arm being capable of providing an elastic supporting force for the elastic locking arm in a direction away from the upper surface of the insulative housing, wherein the locking portion is formed to protrude upwardly from the free end of the elastic locking arm, and wherein an end of the elastic supporting arm close to the elastic locking arm is positioned just below the locking portion.

8. The electrical connector according to claim 7, wherein the elastic locking arm comprises: two side support plates spaced apart from each other and connected to the insulative housing at one end; an end edge portion connecting free ends of the two side support plates; and a base plate connected between the two side support plates;

a thickness of the side support plate gradually becomes small toward the free end of the side support plate.

9. The electrical connector according to claim 7, wherein one end of the elastic supporting arm is connected to a lower surface of the elastic locking arm, the other end of the elastic supporting arm is a free end;

in a free state, the free end of the elastic supporting arm and the upper surface of the insulative housing are spaced apart from each other, and the free end of the elastic supporting arm and the lower surface of the elastic locking arm are spaced apart from each other.

10. The electrical connector according to claim 9, wherein the elastic supporting arm has an oblique segment, the oblique segment obliquely extends in a direction from up to down toward a direction away from the free end of the elastic locking arm.

11. The electrical connector according to claim 7, wherein one end of the elastic supporting arm is connected to the upper surface of the insulative housing, the other end of the elastic supporting arm is a free end;

in a free state, the free end of the elastic supporting arm and the upper surface of the insulative housing are spaced apart from each other, and the free end of the elastic supporting arm and a lower surface of the elastic locking arm are spaced apart from each other.

12. The electrical connector according to claim 7, wherein the elastic supporting arm is more difficult to elastically deform than the elastic locking arm.

13. The electrical connector according to claim 7, wherein the locking portion is formed to protrude upwardly from the free end of the elastic locking arm, and wherein an end of the elastic supporting arm close to the elastic locking arm is positioned just below the locking portion.

14. The electrical connector according to claim 13, wherein the elastic locking arm comprises: two side support plates spaced apart from each other and connected to the insulative housing at one end; an end edge portion connecting free ends of the two side support plates; and a base plate connected between the two side support plates;

a thickness of the side support plate gradually becomes small toward the free end of the side support plate.

15. The electrical connector according to claim 7, wherein the first locking structure further comprises a pressing mechanism, the pressing mechanism has a pressing arm suspended above the elastic locking arm and used to apply a pressure to the elastic locking arm.

16. A connector assembly, comprising:

an electrical connector and a mating connector which are mated with each other, wherein the mating connector is provided with a second locking structure;

the electrical connector is the electrical connector according to claim 7;

when the electrical connector and the mating connector is mated with each other, the locking portion of the electrical connector and the second locking structure of the mating connector are correspondingly locked with each other.

17. An electrical connector, comprising:

an insulative housing;

a plurality of conductive terminals mounted in the insulative housing; and a first locking structure integrally formed on the insulative housing, the first locking structure comprising:

an elastic locking member comprising an elastic locking arm and a locking portion provided on the elastic locking, arm; one end of the elastic locking arm being connected to the insulative housing, the other end of the elastic locking arm being a free end and being suspended above an upper surface of the insulative housing, the elastic locking arm having a first elasticity;

an elastic supporting arm positioned between the elastic locking arm and the upper surface of the insulative housing and having a second elasticity; when the elastic locking arm and the upper surface of the insulative housing together apply a pressure to the elastic supporting arm, the elastic supporting arm being capable of providing an elastic supporting force for the elastic locking arm in a direction away from the upper surface of the insulative housing, wherein the first locking structure further comprises a pressing mechanism, the pressing mechanism has a pressing arm suspended above the elastic locking arm and used to apply a pressure to the elastic locking arm.

18. The electrical connector according to claim 17, wherein one end of the elastic supporting arm is connected to a lower surface of the elastic locking arm, the other end of the elastic supporting arm is a free end;

in a free state, the free end of the elastic supporting arm and the upper surface of the insulative housing are spaced apart from each other, and the free end of the elastic supporting arm and the lower surface of the elastic locking arm are spaced apart from each other.

19. The electrical connector according to claim 18, wherein the elastic supporting arm has an oblique segment, the oblique segment obliquely extends in a direction from up to down toward a direction away from the free end of the elastic locking arm.

20. The electrical connector according to claim 17, wherein one end of the elastic supporting arm is connected to the upper surface of the insulative housing, the other end of the elastic supporting arm is a free end;

in a free state, the free end of the elastic supporting arm and the upper surface of the insulative housing are spaced apart from each other, and the free end of the elastic supporting arm and a lower surface of the elastic locking arm are spaced apart from each other.

21. The electrical connector according to claim 17, wherein the elastic supporting arm is more difficult to elastically deform than the elastic locking arm.

22. A connector assembly, comprising:

an electrical connector and a mating connector which are mated with each other, wherein the mating connector is provided with a second locking structure;

the electrical connector is the electrical connector according to claim 17;

when the electrical connector and the mating connector is mated with each other, the locking portion of the electrical connector and the second locking structure of the mating connector are correspondingly locked with each other.

* * * * *